US006223461B1

(12) United States Patent
Mardirossian

(10) Patent No.: US 6,223,461 B1
(45) Date of Patent: May 1, 2001

(54) FIREARM WITH REMOTELY ACTIVATED SAFETY SYSTEM

(75) Inventor: Aris Mardirossian, Germantown, MD (US)

(73) Assignee: Technology Patents, LLC, Derwood, MD (US)

( * ) Notice: Subject to any disclaimer, the term of this patent is extended or adjusted under 35 U.S.C. 154(b) by 0 days.

(21) Appl. No.: 09/189,990

(22) Filed: Nov. 12, 1998

(51) Int. Cl.[7] ..... F41A 17/00
(52) U.S. Cl. ..... 42/70.11
(58) Field of Search ..... 42/70.11, 70.01; 89/136

(56) References Cited

U.S. PATENT DOCUMENTS

| | | | | |
|---|---|---|---|---|
| 3,400,393 | | 9/1968 | Ash . | |
| 3,939,679 | * | 2/1976 | Barker et al. | 70/277 |
| 4,003,152 | | 1/1977 | Barker et al. . | |
| 4,354,189 | * | 10/1982 | Lemelson | 340/825.31 |
| 4,563,827 | | 1/1986 | Heltzel . | |
| 4,682,435 | | 7/1987 | Heltzel . | |
| 4,811,775 | | 3/1989 | Sun . | |
| 5,415,103 | * | 5/1995 | Radermacher | 102/427 |
| 5,459,957 | | 10/1995 | Winer . | |
| 5,461,812 | | 10/1995 | Bennett . | |
| 5,546,690 | | 8/1996 | Ciluffo . | |
| 5,560,135 | | 10/1996 | Ciluffo . | |
| 5,570,528 | | 11/1996 | Teetzel . | |
| 5,603,180 | | 2/1997 | Houze . | |
| 5,636,464 | | 6/1997 | Ciluffo . | |
| 5,675,925 | * | 10/1997 | Wurger | 42/70.11 |
| 5,722,383 | | 3/1998 | Tippmann, Sr. et al. . | |
| 5,896,691 | * | 4/1999 | Kaminski et al. | 42/70.11 |
| 5,924,232 | * | 7/1999 | Rhoden et al. | 42/70.11 |
| 5,953,844 | * | 9/1999 | Harling et al. | 42/70.06 |

* cited by examiner

*Primary Examiner*—Michael J. Carone
*Assistant Examiner*—Michelle Thomson
(74) *Attorney, Agent, or Firm*—Nixon & Vanderhye P.C.

(57) ABSTRACT

A safety system and method for remotely activating and/or deactivating firearm(s). In certain embodiments, at least one processor or chip may be provided in the firearm. In order to remotely activate a firearm and allow it to be discharged, a controller (located remotely from the firearm) causes an activation signal to be sent to a satellite. The satellite redirects the activation signal toward a particular geographical area. When the firearm to be activated is in that geographical area, it receives the activation signal from the satellite. Upon determining that a match is found between a code in the received activation signal and a predetermined activation code stored in a memory of the firearm, the processor in the firearm causes a trigger lock in the firearm to open thereby enabling the firearm to be discharged whenever a user should decide to load the weapon and pull the trigger. Firearms may be remotely deactivated in a similar manner by way of satellite communication, or any other type of wireless communication such as from a remotely located police transmitter.

7 Claims, 1 Drawing Sheet

FIREARM WITH REMOTELY ACTIVATED SAFETY SYSTEM

This invention relates to a gun or firearm safety system and corresponding method. More particularly, this invention relates to a remotely activatable trigger lock or other safety for a gun which enables a central controller such as a Government authority or a Police Department to selectively activate or deactivate select firearms in different geographical areas throughout the world.

BACKGROUND OF THE INVENTION

U.S. Pat. Nos. 5,461,812; 4,488,370; and 5,459,957 disclose gun safety systems, and are all hereby incorporated herein by reference.

Firearm (e.g. gun) safety is a worldwide concern. Standard in many weapons is a thumb safety and/or grip safety which reduces unintentional firearm discharges. Thumb safeties may operate by manually shifting a safety lever from a safe position to a fire position. Grip safeties may be automatically shifted to fire positions when a user's hand engages the stock of the weapon or even the trigger of the weapon. Neither of these types of safety mechanisms is completely effective to prevent the unauthorized use of a firearm, and thus have proven unsatisfactory in dealing with a variety of safety concerns. Moreover, these prior art systems cannot prevent stolen, or select, weapons from being discharged.

A concern of law enforcement officials is the prevention of law enforcement officers being shot at or killed with an officer's own service weapon. Another concern is firearms of any type being utilized against law enforcement officers. Another concern is the exportation from the United States of U.S. made firearms which ultimately become used against U.S. troops or citizens in foreign countries. For example, it would be undesirable if foreign militaries or terrorists were able to acquire and use U.S. made weapons against U.S. soldiers or U.S. citizens.

There have been prior art attempts to make a weapon operable only by specific authorized users. Some prior art devices require that the user wear a special signal generating (i.e. active) component, such as a ring, bracelet, or glove. In these devices, the firing mechanism will only operate in the presence of a signal generated by the active device. Such devices are deficient for a number of reasons. The active components are cumbersome and uncomfortable to wear, thereby decreasing user acceptance and making the system less reliable. Additionally, the devices are not unique to a given user or a given geographical area because the weapon can still be operated by anyone who has the required signal generator in any area of the world. Another problem is that a firearm cannot be quickly enabled if the user is not presently wearing, or loses, the signal generating device.

In view of the above, it is apparent that there exists a need in the art for police authorities or governmental authorities to be capable of remotely activating and/or deactivating particular or select firearms in different geographical areas around the world. There also exists a need in the art for police or law enforcement officers to be capable of remotely activating or deactivating weapons which may be utilized against them, on short notice.

It is a purpose of this invention to fulfill the above-described needs in the art, as well as other needs which will become apparent to the skilled artisan from the following detailed description of this invention.

SUMMARY OF THE INVENTION

It is an object of this invention to enable Governmental authorities to remotely activate and/or deactivate select firearms in different geographical areas around the world.

It is another object of this invention to allow law enforcement officers (e.g. police officers) to remotely deactivate firearms which they perceive, on short notice, to potentially be utilized against them.

It is another object of this invention to utilize a satellite to enable Governmental authorities and/or law enforcement authorities to remotely deactivate and/or activate select firearms.

It is still another object of this invention to provide firearms with a processor chip therein which is capable of receiving deactivation and/or activation signals from a satellite in order to selectively deactivate/activate the firearm. When activated, the firearm may be utilized to fire or discharge bullets, and when deactivated a trigger lock or the like may be utilized to prevent the firearm from being discharged.

Another object of this invention is to provide a plurality of firearms, each with at least one processor chip therein which receives remote orders from a satellite or from a police transmitter in order to activate or deactivate the firearm. In such a manner, in certain embodiments, firearms may be shut down or deactuated by way of a trigger lock if they are reported or believed to be stolen.

Still another object of this invention is to provide a system for deactivating/activating firearms via satellite signals, by way of selective frequencies and/or codes being transmitted to firearms via satellites. In such a manner, the frequencies and/or codes may be changed on a daily basis for security purposes, with the chip in each firearm being programmed in advanced to know which frequencies and/or codes may be utilized on particular days of the year to activate or deactivate each firearm.

It is still another object of this invention to permanently deactivate a firearm (e.g. gun) if a processor chip therein is removed, tampered with, or deactivated.

This invention further fulfills the above identified needs in the art by providing a method of distributing, activating, and deactivating a firearm, the method comprising:

providing a firearm including a receiving antenna, a processor, a memory, and a locking device for selectively preventing the firearm from being able to be discharged;

distributing the firearm;

transmitting an activation signal, via a transmitting antenna located remote from the firearm, to a satellite;

the satellite receiving the activation signal including activation information therein;

the satellite transmitting an earthward-directed signal toward a first geographic area on planet earth, to the exclusion of other geographic areas on planet earth;

the firearm being located in the first geographic area and the receiving antenna of the firearm receiving the earthward-directed signal from the satellite;

the processor of the firearm causing the locking device to unlock in response to detection of the receiving antenna receiving the earthward-directed signal from the satellite so that the firearm may be discharged;

transmitting a deactivation signal, via a transmitting antenna located remote from the firearm, to the satellite;

the satellite receiving the deactivation signal including deactivation information therein, and in response thereto transmitting an earthward-directed deactivation signal toward the first geographic area on planet earth; and the receiving antenna of the firearm receiving the earthward-directed deactivation signal from the satellite and the processor in response thereto causing the locking device to lock the firearm against discharge so as to prevent the firearm from being discharged.

This invention still further fulfills the above described needs in the art by providing a system for deactivating a firearm and preventing the firearm from discharging, the system comprising:

the firearm including a receiving antenna, a processor, a memory, and means for selectively preventing the firearm from discharging;

an antenna located remote from the firearm, said antenna for transmitting a deactivation signal to at least one satellite;

said at least one satellite for receiving the deactivation signal;

said at least one satellite for transmitting an earthward-directed deactivation signal toward a first geographic area on planet earth, to the exclusion of other geographic areas on planet earth;

the firearm being located in the first geographic area, and the receiving antenna of the firearm receiving the earthward-directed deactivation signal from said at least one satellite; and the processor of the firearm, in response to detecting reception of the earthward-directed deactivation signal, causing the means for selectively preventing the firearm from discharging to prevent the firearm from being discharged.

This invention will now be described with respect to certain embodiments thereof, along with reference to the accompanying illustrations.

IN THE DRAWINGS

DETAILED DESCRIPTION OF CERTAIN EMBODIMENTS OF THIS INVENTION

Figure 1:
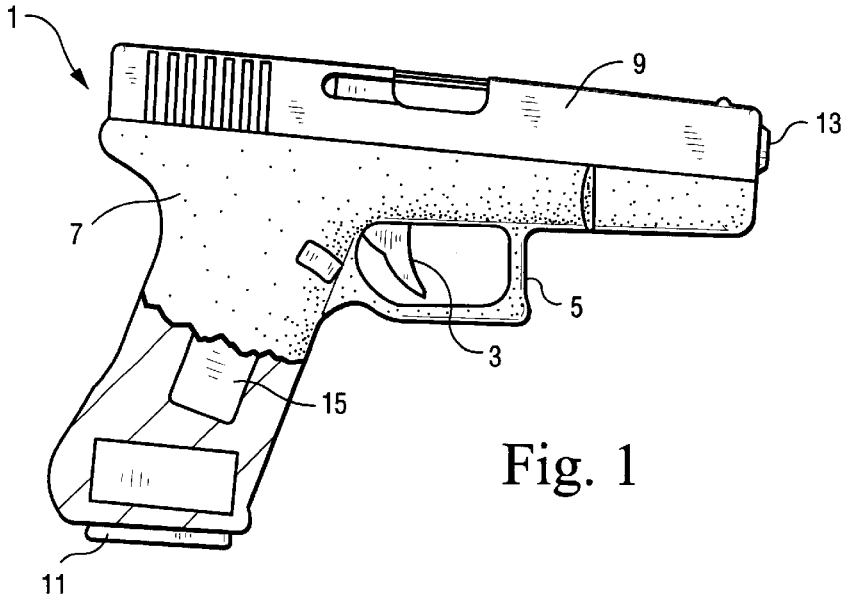
FIG. 1 is a side plan view of a firearm according to an embodiment of this invention.

Referring now more particularly to the accompanying drawings in which like reference numerals indicate like parts throughout the several views.

FIG. 1 is a side plan view of a firearm 1. Firearm 1 may be a hand-gun, rifle, grenade launcher, anti-tank weapon, or any other type of firearm operable by a human operator. For example, firearm 1 may be a 9 mm pistol such as a Glock 17, or alternatively may be an assault rifle such as an AK-47, M-16, or the like.

Firearm 1 includes a system for electronically enabling its operation for intended use. Firearm 1 includes trigger 3, trigger guard 5, plastic or metal body housing 7, metallic bore area 9, magazine 11 for holding a number of bullets which may be selectively inserted and/or removed from housing 7, and barrel 13 which extends through member 9. A processor chip 15 is mounted on or within firearm 1. Firearm 1 is only permitted to be fired or discharged when processor 15 unlocks or opens trigger lock 17 (i.e. thereby activating the weapon). Processor 15 may be instructed to either activate (unlock trigger guard) or deactivate (lock trigger guard) firearm 1 from a remote location by way of radio signals, satellite signals, microwave signals, or the like.

Figure 2:
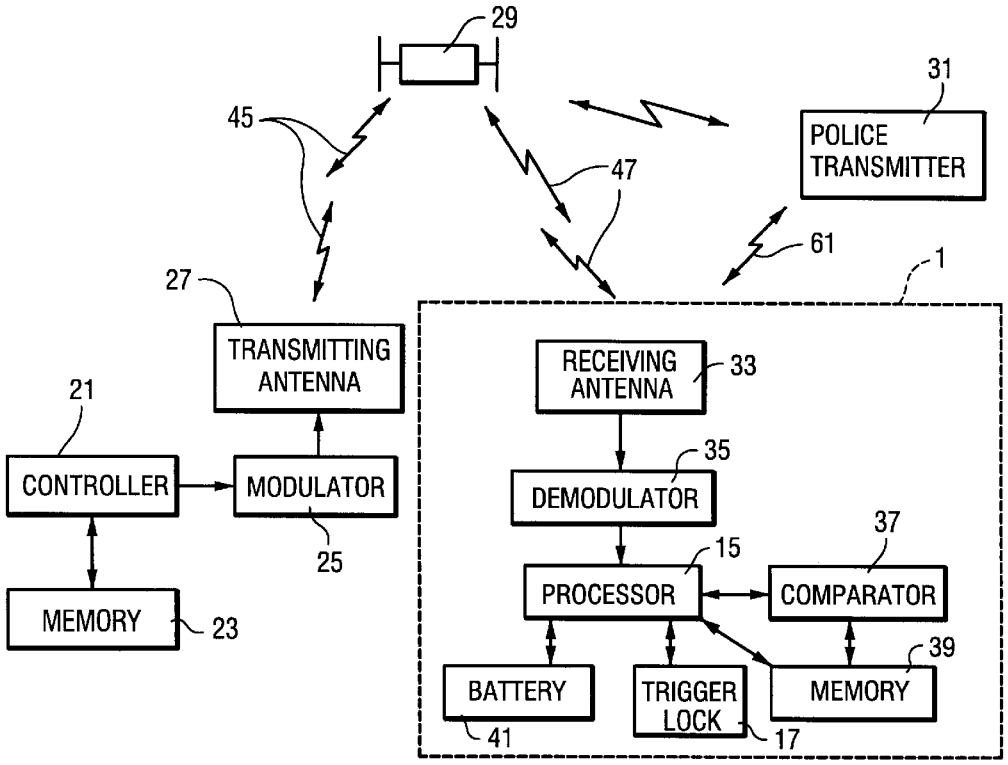
FIG. 2 is a schematical block diagram illustrating electronic components of the safety system and method which may be utilized for remotely activating and/or deactivating the firearm of FIG. 1.

FIG. 2 illustrates a schematic or block diagram of a safety system and method which may be utilized to remotely activate or deactivate firearm 1 so as to either allow the firearm to be discharged or to cause it to be locked in order to prevent its discharge. The safety system includes central controller 21, memory 23, modulator 25, and transmitting antenna 27 which are at a given location preferably remotely located relative to firearm 1. Components 21–27 may communicate with firearm 1 by way of satellite 29 or any other atmospheric-free space telecommunications method or system (e.g. microwave, radio signals, etc.). In certain optional embodiments, a police transmitter 31 may also be provided at a location remote from firearm 1.

Attached to, or within, firearm 1 are receiving antenna 33, signal demodulator 35, processor or controller chip 15, comparator 37, memory 39, trigger lock or other mechanical activation/deactivation mechanism 17, and battery 41 for supplying electrical power to these elements within firearm 1.

According to certain embodiments of this invention, a Governmental authority or anyone else may sell or otherwise distribute a plurality (e.g. thousands) of firearms 1 to customers throughout the United States or anywhere else throughout the world. Each of these firearms may include a processor 15, trigger lock 17, and each of the other elements 33–41 shown in FIG. 2. Each firearm, upon shipment or sale, may in certain embodiments be programmed so that the trigger lock 17 is in a position or state so as to prevent the firearm from being discharged or fired. Thereafter, at a given point in time, a Governmental authority or police authority may activate select firearms as follows. Such authority may cause controller 21 to look up in memory 23 to determine the frequency or code needed to activate a particular firearm 1 (or group of firearms 1) based upon predetermined serial number(s) or identification number(s) of the firearm(s) to be activated. Upon determining the appropriate digital activation code or frequency from memory 23, controller 21 outputs a signal which is modulated at 25 and is thereafter transmitted at 27 through atmospheric free space to satellite 29 as signal 45. Signal 45 (and 47) may be modulated in a spread spectrum manner, via QPSK, via DQPSK, via OPQSK, via QAM, via TDM, via COFDM, or any other appropriate type of modulation.

After satellite 29 receives activation signal 45, it in turn directs this same activation signal toward a particular geographical area on Earth as signal 47 (e.g. into a particular country, state, county, portion thereof or continent). Firearms 1 located in that particular geographical area receive activation signal 47 by way of antenna 33. Firearms 1 not in that geographical area do not receive the activation signal.

Upon reception by a firearm of activation signal 47, which passes through antenna 33, the demodulator 35 in the firearm 1 demodulates the signal so that it can be interpreted by way of either the demodulator 35 or processor 15. Thereafter, processor 15 causes the received information to be compared predetermined information (e.g. bit code) stored in memory 39, by way of comparator 37. If processor 15 or the comparator determines, from this comparison in comparator 37, that the information bits from the received activation signal 47 matches one of a predetermined number (e.g. 1–100) of activation signals (e.g. bit code) stored in memory 39, then the processor instructs trigger lock 17 to unlock and thus activate the firearm and allow trigger 3 to be pulled so as to enable the firearm 1 to be discharged when desired by a user.

For example, according to certain embodiments, the aforesaid plurality of firearms 1 could be made in the U.S.

and exported from the United States to a foreign country such as Israel, U.K., or Saudi Arabia. After arriving in the foreign country, controller 1 may cause an activation signal 45 to be sent to a particular satellite or group of satellites 29 which in turn direct(s) activation signal(s) 47 toward a particular geographical location (e.g. to cover the foreign country or portion thereof) and thus toward at least a plurality of the firearms. Thus, only those firearms which made their way to that intended particular geographical area are activated so as to enable only those firearms to be capable of being discharged by users. Firearms 1 which, for one reason or another, such as being stolen, do not reach their intended destination in the foreign country will remain deactivated and will not receive or be activated by signal 47 which is only directed toward the specific geographical location (e.g. in Saudi Arabia, U.S., and/or Israel). The activated firearms may remain activated for either a short or a long period of time. For example, they may remain activated for five (5) years, or only one (1) week. If, however, there becomes a need to deactivate these activated firearms (e.g. they are captured or stolen by a foreign Government or terrorists, and potentially could be used against U.S. troops or citizens), then controller 21 can access memory 23 in order to determine a deactivation code or frequency to be used to deactivate those particular select firearms 1. The controller 21 can retrieve this deactivation code or frequency, cause it to be modulated at 25, and cause antenna 27 to transmit or generate the deactivation signal 45 and direct it toward satellite 29 which can redirect it as deactivation signal 47 toward a given geographical location (e.g. throughout portions of Saudi Arabia, Iraq or the like). Firearms 1 receiving the deactivation signal 47 from satellite 29 will receive it by way of antenna 33, demodulate it at 35, process it at 15, and compare it at 37 with known activation and deactivation bit code signals stored in memory 39. If processor 15 determines that the received bit information or signal 47 matches that of a known deactivation signal from memory 39 for that particular firearm, then processor 15 causes trigger lock 17 of firearm 1 to lock trigger 3 against movement so as to deactivate the weapon and prevent it from being fired. The firearm remains deactivated until it receives an activation signal from the satellite.

Moreover, in certain embodiments of this invention, any removal, tampering with, or attempt to remove processor 15 or trigger lock 17 from firearm will cause the firearm to be permanently deactivated. Trigger lock 17 may instead be replaced with other types of mechanical or electrical activation/deactivation devices in the weapon.

In such a manner, if weapons originating from the United States make their way into the hands of terrorists or other undesirables, it is possible to deactivate these weapons selectively from a remote location, i.e. once they make their way into the hands of terrorists or governments adverse to the United States. Again, activation signals may activate firearms 1 at any time, and deactivation signals may deactivate them at any time. Each firearm 1 may be activated or deactivated any number of times, from one through thousands. Memory 23 may store therein from 1–1,000 activation and/or deactivation codes for each particular firearm based upon the serial number or other identification number of that firearm.

According to certain other embodiments of this invention, the safety system of FIGS. 1–2 may be utilized to deactivate firearms which are stolen either from individuals, the military, or from police officers. For example, if a given firearm is reported as being stolen or even lost, controller 21 can look up in memory 23 predetermined digital codes or frequencies which may be utilized to deactivate that particular firearm based upon its serial number or ID number. Such codes or frequencies in memory 23 may be stored at addresses corresponding to particular serial number(s) of different firearm(s) 1. Once controller 21 determines which deactivation digital code or frequency to be utilized for that firearm, it retrieves this code from memory 23, causes it to be modulated at 25 with a carrier signal, and transmits it 27 toward satellite 29 as deactivation signals 45. Satellite 29 redirects these deactivation signal(s) toward a predetermined geographical area (e.g. the entire United States or a portion thereof) as deactivation signal(s) 47 where the stolen firearm is expected to be located. If the stolen firearm 1 receives this deactivation signal 47, it does so by way of receiving antenna 33. The signal is then demodulated at 35 and forwarded to processor 15. Processor 15 compares the deactivation signal information with a deactivation signal code or signals stored in memory 39 by way of comparator 37. If a match is found with a deactivation signal from memory 39, then processor 51 determines this match and automatically instructs trigger lock 17 to prevent the firearm from being discharged (i.e. to deactivate the stolen firearm). In such a manner, stolen firearms, identifiable by serial number or the like, may be deactivated from remote locations by way of satellite 29 to prevent thieves or foreign governments from utilizing stolen firearms. Firearms 1 may optionally include an ID transmitter therein for helping stolen weapons to be located.

Moreover, as set forth above, any removal or attempt to remove processor 15 or any other of components 33–41 from firearm 1 will cause the firearm to automatically deactivate and not be able to be discharged.

Once the firearm 1 is recovered, and returned to its original owner, controller 21 can access an activation signal from memory 23 at a location in the memory corresponding to the serial number of the firearm. Controller 21 retrieves this activation signal from memory 23, causes it to be modulated at 25 and transmitted 27 toward satellite 29. The satellite redirects the activation signal toward receiving antenna 33 of the firearm, and after processor 15 determines that the activation signal matches an activation signal stored in memory 39 at comparator 37, the processor 15 automatically instructs the trigger lock 17 to open thereby again activating firearm 1 and allowing it to be discharged. If no match is found, then the firearm will remain deactivated.

According to still further embodiments of this invention, individual police cars or policemen may carry police transmitters 31. A police transmitter 31, when activated by a police officer, may transmit a generic deactivation signal 61 in all directions at a low strength so as only to be received in a predetermined area (e.g. up to about 100–1,000 yards from the transmitter 31). Thus, should a police officer carrying a transmitter 31 encounter a thief or other criminal who is attempting to use a firearm 1 against the officer, the officer may activate his or her transmitter 31 and cause a deactivation signal 61 to be output. The firearm 1 in the hands of the criminal receives deactivation signal 61 by way of antenna 33. The firearm then demodulates the deactivation signal at 35 and processor 15 causes the received bit or signal information to be compared with generic signals or information in memory 39 by way of comparator 37 (the firearm may store both generic deactivation codes and the serial number specific codes mentioned above in its memory). If processor 15, by way of comparison 37, determines that the received bit information or signal 61 matches a generic deactivation code or signal stored in memory 39, then processor 15 instructs trigger lock 17 to lock trigger 3 against movement thereby deactivating the firearm 1. Thus, an officer may, by activating transmitter 31, prevent a proximate firearm 1 from being used against the officer. At a later point in time, after the criminal has been apprehended, the firearm 1 may be reactivated either by way of controller 21 sending an activation signal 45 based on the serial number of the firearm 1, or alternatively by police transmitter 31 emitting an activation signal that is either a generic activation signal or an activation signal based upon the serial number of the firearm. Police transmitter 31 may be worn on the wrist of a police officer, it may be located in a police cruiser, or may even be attached to a firearm carried by a police officer so that the officer can easily activate transmitter 31 while the officer is handling his or her weapon. Optionally, transmitter 31 may transmit short-term deactivation signals which causes a firearm to be deactivated for only a predetermined period of time (e.g. one (1) hour), and thereafter automatically reactivate.

According to still other embodiments of this invention, memory 39 in the firearm 1 and memory 23 can each store a plurality of different activation and/or deactivation digital codes or frequencies. For example, each memory 39 and 23 may store a different activation code or frequency for each day of the year, and/or a different deactivation code or frequency for each day of the year (only one code will work on a given date). Processor 15 and controller 21 may each include a timer which keeps track of the date of the calendar year and may each retrieve the code from the corresponding memory based upon the date. Thus, both memory 23 and memory 39 may store up to three hundred sixty-five (365) different deactivation codes or frequencies for each firearm 1 and up to three hundred sixty-five (365) different activation codes or frequencies for each particular firearm 1, as designated by the firearm serial number or other identification number. Accordingly, when it is desired to deactivate a firearm 21 on e.g. Jul. 27, 1999, then controller 1 will retrieve from memory 23 the particular deactivation code or frequency specified for that particular date for the select firearm as designated by its serial number. Controller 21 will then cause it to be modulated and transmitted to satellite 29 which redirects the signal toward an area believed to include the firearm 1. If the firearm receives it, the processor 15 retrieves from memory 39 the appropriate activation and deactivation signals for that particular date. Comparator 37 performs a comparison between the signal received from the satellite and the two signals received from memory 39. If a match is found with the deactivation signal retrieved from memory 39 for that particular date, then processor 15 instructs trigger lock 17 to lock the firearm and deactivate it. Meanwhile, if a match is found between the received signal 47 and the activation signal retrieved from memory 39 for that particular date, then processor 15 instructs the trigger lock to open. The storing of date-precise activation and deactivation signals in memories 23 and 39 increases the overall security of the system and helps to prevent unauthorized discharging of weapons.

According to certain embodiments, the invention may further include the step of changing identification information stored in the firearm at predetermined or random intervals, and at least one of activation or deactivation of the firearm being possible only when the firearm determines or detects that a received signal includes information indicative of or matching correct identification information stored in the firearm at the time the received signal is received by the firearm.

Once given the above disclosure, many other features, modifications, and improvements will become apparent to the skilled artisan. Such other features, modifications, and improvements are, therefore, considered to be a part of this invention, the scope of which is to be determined by the following claims.

I claim:

1. A method of distributing, activating, and deactivating a firearm, the method comprising:

providing a firearm including a receiving antenna, a processor, a memory, and a locking device for selectively preventing the firearm from being able to be discharged;

distributing the firearm;

transmitting an activation signal, via a transmitting antenna located remote from the firearm, to a satellite;

the satellite receiving the activation signal including activation information therein;

the satellite transmitting an earthward-directed signal toward a first geographic area on planet earth, to the exclusion of other geographic areas on planet earth;

the firearm being located in the first geographic area and the receiving antenna of the firearm receiving the earthward-directed signal from the satellite;

the processor of the firearm causing the locking device to unlock in response to detection of the receiving antenna receiving the earthward-directed signal from the satellite so that the firearm may be discharged;

transmitting a deactivation signal, via a transmitting antenna located remote from the firearm, to the satellite;

the satellite receiving the deactivation signal including deactivation information therein, and in response thereto transmitting an earthward-directed deactivation signal toward the first geographic area on planet earth;

the receiving antenna of the firearm receiving the earthward-directed deactivation signal from the satellite and the processor in response thereto causing the locking device to lock the firearm against discharge so as to prevent the firearm from being discharged; and chancing identification information stored in the firearm at predetermined or random intervals, and at least one of activation or deactivation of the firearm being possible only when the firearm determines or detects that a received signal includes information indicative of or matching correct identification information stored in the firearm at the time the received signal is received by the firearm.

2. The method of claim 1, wherein the steps recited are performed in the order in which the steps are recited.

3. The method of claim 1, wherein the transmitting antenna is located on a first continent on planet earth and the firearm is located on a second continent on planet earth different from the first continent; and wherein the transmitting antenna is controlled by a governmental authority.

4. The method of claim 1, wherein said locking device is one of a mechanical locking device which is capable of mechanically locking the firearm against discharge, and an electrical locking device which is capable of electrically preventing the firearm from discharging.

5. The method of claim 1, further comprising the steps of:

providing a plurality of different firearms, each including at least one said receiving antenna, at least one said processor, at least one said memory, and at least one said locking device for selectively preventing the firearm from being able to be discharged;

each of said plurality of different firearms including a different identification code stored in the memory therein, so that each of said firearms can be selectively activated or deactivated;

wherein said step of transmitting an earthward-directed deactivation signal further includes the step of including identification information in the earthward-directed deactivation signal corresponding to the identification code of one of said plurality of different firearms; and said one firearm receiving said earthward-directed deactivation signal recited in the previous paragraph, and the processor of said one firearm determining if a match is found between the identification information in the received deactivation signal and the identification code stored firearm, and the processor causing the locking device to lock the firearm against discharge so as to prevent the firearm from being discharged on when said match is found or detected.

6. The method of claim 1, further comprising the step of permanently deactivating the firearm when it is detected that a processor chip therein is tampered, removed, or manipulated in any way.

7. The method of claim 1, wherein the firearm further includes a demodulator, a comparator, and a battery, and wherein the comparator compares received information with information stored in the memory of the firearm and the firearm is activated or deactivated on the basis of the comparison performed by the comparator.

* * * * *